US005860315A

United States Patent [19]

Sawdon

[11] Patent Number: 5,860,315

[45] Date of Patent: Jan. 19, 1999

[54] DEVICE FOR SECURING TOOLS

[75] Inventor: Edwin G. Sawdon, St. Clair, Mich.

[73] Assignee: ETM Corporation, Marysville, Mich.

[21] Appl. No.: 743,333

[22] Filed: Nov. 4, 1996

[51] Int. Cl.[6] ..... B21D 37/04

[52] U.S. Cl. ..... 72/481.8; 72/481.3; 83/698.91

[58] Field of Search ..... 72/481.3, 481.5, 72/481.6, 481.7, 481.8, 481.9, 482.94; 83/698.71, 698.91

[56] References Cited

U.S. PATENT DOCUMENTS

| | | | |
|---|---|---|---|
| 1,190,696 | 7/1916 | Wilzin . | |
| 1,211,333 | 1/1917 | Miller . | |
| 1,404,126 | 1/1922 | Krause . | |
| 1,778,339 | 10/1930 | Rafter . | |
| 2,028,354 | 1/1936 | Roe . | |
| 2,393,986 | 2/1946 | Gullberg | 83/698.91 |
| 2,670,885 | 3/1954 | Allen . | |
| 2,816,288 | 12/1957 | Heilman . | |
| 3,137,193 | 6/1964 | Whistler, Sr. et al. | 83/698.91 |
| 3,269,168 | 8/1966 | Anderson . | |
| 3,359,935 | 12/1967 | Rosbottom . | |
| 3,404,648 | 10/1968 | Rosbottom . | |
| 3,468,527 | 9/1969 | Mather . | |
| 3,690,141 | 9/1972 | Brownbill . | |
| 3,715,947 | 2/1973 | Weisbeck et al. | 83/698.91 |
| 3,730,044 | 5/1973 | Sawdon . | |
| 4,096,776 | 6/1978 | Laucke | 83/698.91 |
| 4,208,776 | 6/1980 | Schleicher . | |
| 4,459,735 | 7/1984 | Sawdon . | |
| 4,574,473 | 3/1986 | Sawdon . | |
| 4,722,647 | 2/1988 | Sawdon . | |
| 4,736,612 | 4/1988 | Russell | 72/389 |
| 4,738,130 | 4/1988 | Homma . | |
| 4,757,609 | 7/1988 | Sawdon . | |
| 4,825,525 | 5/1989 | Obrecht . | |
| 4,878,284 | 11/1989 | Sawdon . | |
| 4,905,362 | 3/1990 | Obrecht . | |
| 4,910,853 | 3/1990 | Sawdon . | |
| 4,912,961 | 4/1990 | Brown . | |
| 4,930,203 | 6/1990 | Obrecht . | |
| 5,027,503 | 7/1991 | Sawdon . | |
| 5,031,442 | 7/1991 | Kynl . | |
| 5,131,258 | 7/1992 | Kynl . | |
| 5,150,513 | 9/1992 | Sawdon . | |
| 5,177,861 | 1/1993 | Sawdon . | |
| 5,207,086 | 5/1993 | Kynl . | |

(List continued on next page.)

FOREIGN PATENT DOCUMENTS

| | | | |
|---|---|---|---|
| 206465 | 10/1954 | Australia . | |
| 1452782 | 3/1969 | Germany . | |
| 372392 A1 | 2/1989 | Germany . | |
| 4335318 A1 | 4/1994 | Germany . | |
| 56-50732(A) | 5/1981 | Japan . | |
| 58-168454 | 10/1983 | Japan | 72/481.9 |
| 62-148039 | of 1987 | Japan . | |
| 62-148035(A) | 7/1987 | Japan . | |
| 62-148036(A) | 7/1987 | Japan . | |
| 62-148040(A) | 7/1987 | Japan . | |
| 4-158944 | 6/1992 | Japan | 72/481.6 |
| 4-158944(A) | 6/1992 | Japan . | |
| 127231 | 1/1960 | U.S.S.R. | 72/462 |
| 161209 | 4/1964 | U.S.S.R. . | |
| 1299669 | 3/1987 | U.S.S.R. . | |
| WO 93 14893 | 8/1993 | WIPO . | |

OTHER PUBLICATIONS

American Society of Tool Engineers, Tool Engineers Handbook, Sections 97 and 98, pp. 1494–1578 (1949).

D. Eary, et al., "Techniques of Pressworking Sheet Metal", Second Edition, Prentice Hall, Inc., pp. 332–333, Fig. 300 (1974).

BTM Tog–L–Loc 940 Series Sheet Metal Joining System (prior to Nov. 4, 1996).

*Primary Examiner*—David Jones

*Attorney, Agent, or Firm*—Harness, Dickey & Pierce, P.L.C.

[57] ABSTRACT

A device for securing a tool includes a punch or die having a recess disposed within an exterior surface for mating with an engagement member. Another aspect of the present invention provides an engagement member with a partially spherical external surface.

33 Claims, 5 Drawing Sheets

U.S. PATENT DOCUMENTS

| | | |
|---|---|---|
| 5,208,973 | 5/1993 | Sawdon . |
| 5,208,974 | 5/1993 | Sawdon . |
| 5,267,383 | 12/1993 | Sawdon . |
| 5,339,509 | 8/1994 | Sawdon . |
| 5,435,049 | 7/1995 | Sawdon . |
| 5,479,687 | 1/1996 | Sawdon . |
| 5,509,290 | 4/1996 | Faivre . |
| 5,528,815 | 6/1996 | Webb . |
| 5,581,860 | 12/1996 | Sawdon . |

DEVICE FOR SECURING TOOLS

CROSS REFERENCE TO RELATED APPLICATIONS

This is a continuation-in-part of co-pending international application serial number PCT/US94/08561 which was filed on Jul. 29, 1994 and designated the United States.

BACKGROUND AND SUMMARY OF THE INVENTION

This invention relates generally to a device for securing a tool to a fixture and specifically to a retainer which engages a recess within a punch or die assembly.

Within the equipment, tool and die making industries, it is common to provide various fastening means between machinery components. For example, sheet metal stamping and injection molding dies are typically fastened to their respective die plates by bolts extending through countersunk holes within the die. These bolts have a head which engages the die and a threaded shank which enmeshes with a receiving hole in the die plate. Typically four or more bolts are required to retain each die.

Other conventional die holding devices are known which employ a plurality of gooseneck clamps, dog clamps, wedge bevels or the like. Examples of such devices are disclosed within U.S. Pat. No. 4,912,961 entitled "Structure for Securing a Die to a Bolster Plate" which issued to Brown on Apr. 3, 1990, U.S. Pat. No. 3,269,168 entitled "Die Apparatus" which issued to Anderson on Aug. 30, 1966, U.S. Pat. No. 2,028,354 entitled "Adjustable Die Holder" which issued to Roe on Jan. 21, 1936, U.S. Pat. No. 1,778,339 entitled "Die Holder" which issued to Rafter on Oct. 14, 1930, Japanese Patent Publication No. 56-50732 entitled "Upper Die Clamping Device in Forging Press" to Sumitomo Jukikai Kogyo K.K. (May 8, 1981), Japanese Patent Publication No. 4-158944 entitled "Die Clamping Mechanism for Punching Press" to Murata Mach Ltd. (Jun. 2, 1992), Soviet Union Patent No. 161209 entitled "Device for Securing Hammer Blocks on Radial-Forging Machines" to Reznikov (Apr. 9, 1964,) and D. Eary and E. Reed, *Techniques of Press Working Sheet Metal: An Engineering Approach to Die Design*, Second Edition, Prentice-Hall, Inc. (1974) at pages 323–333. However, all of these conventional devices require multiple fasteners for each tool, are not well suited for engagement with cylindrically-shaped tools, appear to be too inaccurate for use with small tools (e.g., having an outer diameter of approximately 10 mm) and are prone to loosening in the highly vibration prone work environment thereby leading to inaccurate tool placement, premature tool failure and poor quality processed parts.

In accordance with the present invention, the preferred embodiment of a device for securing a tool includes a punch or die having a recess disposed within an exterior surface for mating with an engagement member. Another aspect of the present invention provides an engagement member with a partially spherical external surface and an internal passageway for receiving a threaded shank of a screw. In a further aspect of the present invention, the recess has an undercut section, a generally flat middle section and a partially spherical section, wherein the partially spherical external surface of the engagement member mates with the partially spherical section of the tool recess. In yet another aspect of the present invention, the tool is a sheet metal joining punch. In still another aspect of the present invention, the tool is a sheet metal joining die. A method of securing a tool to a fixture is also provided.

The present invention is advantageous over traditional devices in that the present invention secures a tool to a fixture by use of a single retainer. This leads to extremely quick tool changeover which promotes higher productivity and lower set up costs. The shape of the recess and engagement member have also proven extremely advantageous over conventional devices since they cause a highly secure wedging action upon affixation or enmeshing so as to accurately and repeatedly locate and maintain the tool in the desired position. This reduces premature failure and breakage of mating punches and dies while also improving processed part-to-part tolerances and repeatability throughout prolonged usage in the typically harsh plant environment. The directional forces caused by the engaged interaction of the fixture, tool and retainer also promote accurate and secure retention. Additional advantages and features of the present invention will become apparent from the following description and appended claims, taken in conjunction with the accompanying drawings.

DETAILED DESCRIPTION OF THE PREFERRED EMBODIMENT

Figure 1:
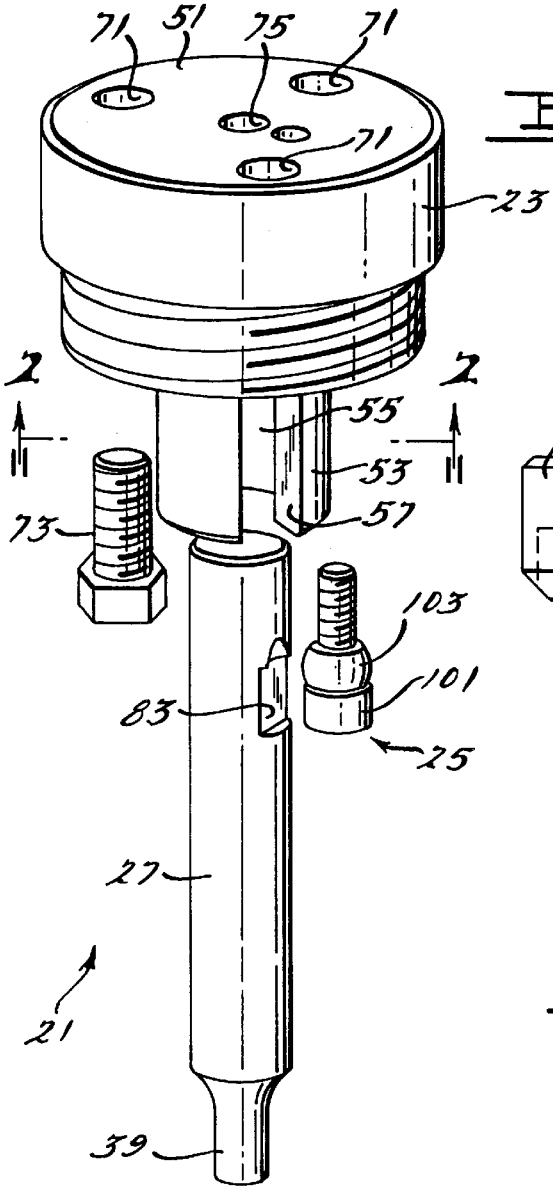
FIG. 1 is an exploded perspective view showing a preferred embodiment of a device for retaining a punch of the present invention.
Figure 9:
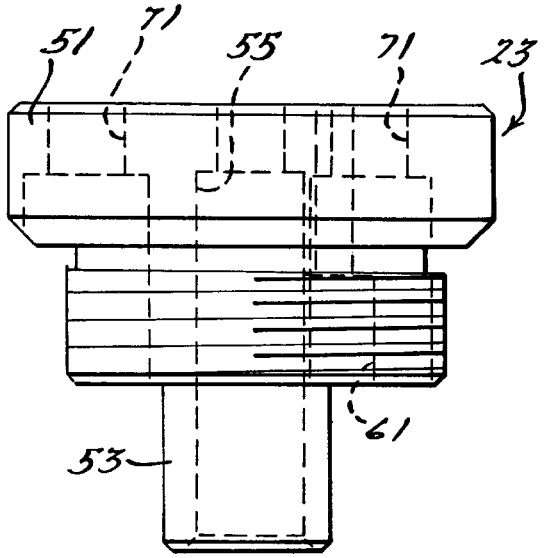
FIG. 9 is a side elevational view showing the preferred embodiment of a punch holder of the present invention.
Figure 10:
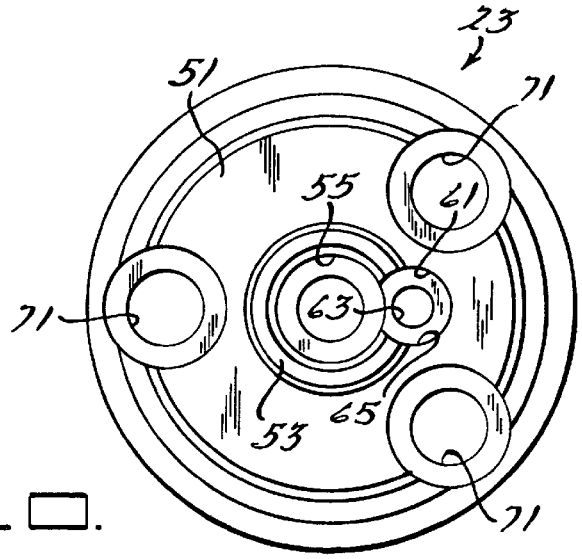
FIG. 10 is an end elevational view showing the preferred embodiment of the present invention punch holder.

The device of the present invention serves to secure a tool to a fixture. The present invention apparatus may be employed with tools such as punches, dies, molds, shearing blades or the like. The present invention retaining device may also be used for various fixtures such as punch holders, punch shoes, die holders, die shoes, die plates, presses, building floors, building walls, tables or other such work surfaces. In the presently preferred embodiment of the device for securing tools, a punch assembly operates in conjunction with a die assembly for joining a pair of aluminum or steel sheets of material to form an expanded and lanced joint, or an interlocking and leakproof button type joint. Such a punch assembly, die assembly and joints are generally of the type disclosed within U.S. Pat. No. 5,150,513 entitled "Apparatus for Joining Sheet Material" which issued to Sawdon on Sep. 29, 1992, and is incorporated by reference herewithin.

Referring to FIGS. 1–4, the preferred embodiment of the present invention employs a punch assembly 21, a fixture or punch holder 23 and a retainer 25. Punch assembly 21 includes a punch 27, a helically wound stripper spring 29, a stripper tip 31 and an outer protective stripper can 33. Spring 29 has a first coil abutting against a shoulder 35 of punch holder 23 and has a last coil abutting against a laterally extending annular ledge 37 of tip 31. Spring 29 serves to bias tip 31 away from punch holder 23 so as to facilitate retraction of a distal punching end 39 from the joint formed in the sheets of material. Tip 31 further has a centrally located, round aperture through which distal end 39 of punch 27 can extend.

Referring now to FIGS. 1, 2, 9 and 10, punch holder 23 has a body 51 and a centrally extending collar 53 within which are disposed a longitudinally oriented punch receiving cavity 55. Collar 53 has generally cylindrical external and internal surfaces with a longitudinally oriented slot 57 allowing access therethrough. Punch holder 23 additionally contains a counterbore 61 having a threaded opening portion 63 and a laterally enlarged receptacle portion 65. Laterally enlarged portion 65 of counterbore 61 is defined by a cylindrical inner surface which intersects punch receiving cavity 55 to create slot 57. A portion of the punch holder's exterior is threaded for fastening to mating threads internally disposed within can 33. Moreover, a set of countersunk apertures 71 are also drilled through punch holder 23 for receiving a corresponding set of M6×1×16 mm S.H.C.S. screws 73. A 6 mm×16 mm dowel (not shown) is also centrally disposed within a through aperture 75 in punch holder 23. Screws 73 and dowel 75 serve to secure punch holder 23 to an upper shoe 77 of a C-type press.

As can best be observed in FIGS. 3–6 and 11, punch 27 has a longitudinally elongated, circular-cylindrical, external surface 81 within which is machined a notch or recess 83. Recess 83 is defined by an undercut section 85, a generally flat middle section 87 and a partially spherical section 89. Undercut section 85 extends in a generally lateral direction while flat section 87 extends in a generally longitudinal direction.

Referring to FIGS. 1–4, 7 and 8, retainer 25 includes an M4×0, 7–6H socketed cap screw 101, grade 10.9, and an M2 tool steel washer 103. Screw 101 consists of a threaded shank 105 and a head 107 which is cold formed onto shank 105. A hexagonal wrench receiving receptacle is disposed within head 107. Head 107 further has a cylindrical peripheral surface 109 and a flat upper surface 111.

Washer 103, acting as an engagement member, has a partially spherical lateral, external surface with a greater end view radius than partially spherical section 89 of recess 83. Washer 103 also has a generally flat upper surface 123 and a generally flat lower surface 125, which are both joined to an internal surface 127 by frusto-conical tapers 129. Internal surface 127 defines a longitudinally oriented passageway within which is received shank 105 of screw 101. Lower surface 125 of washer 103 abuts against upper surface 111 of screw 101. Washer 103 has an annular configuration with a uniform cross section. Either head 107 or washer 103 are also sometimes referred to as a protuberance which laterally extends from shank 105.

Figures 2, 12:
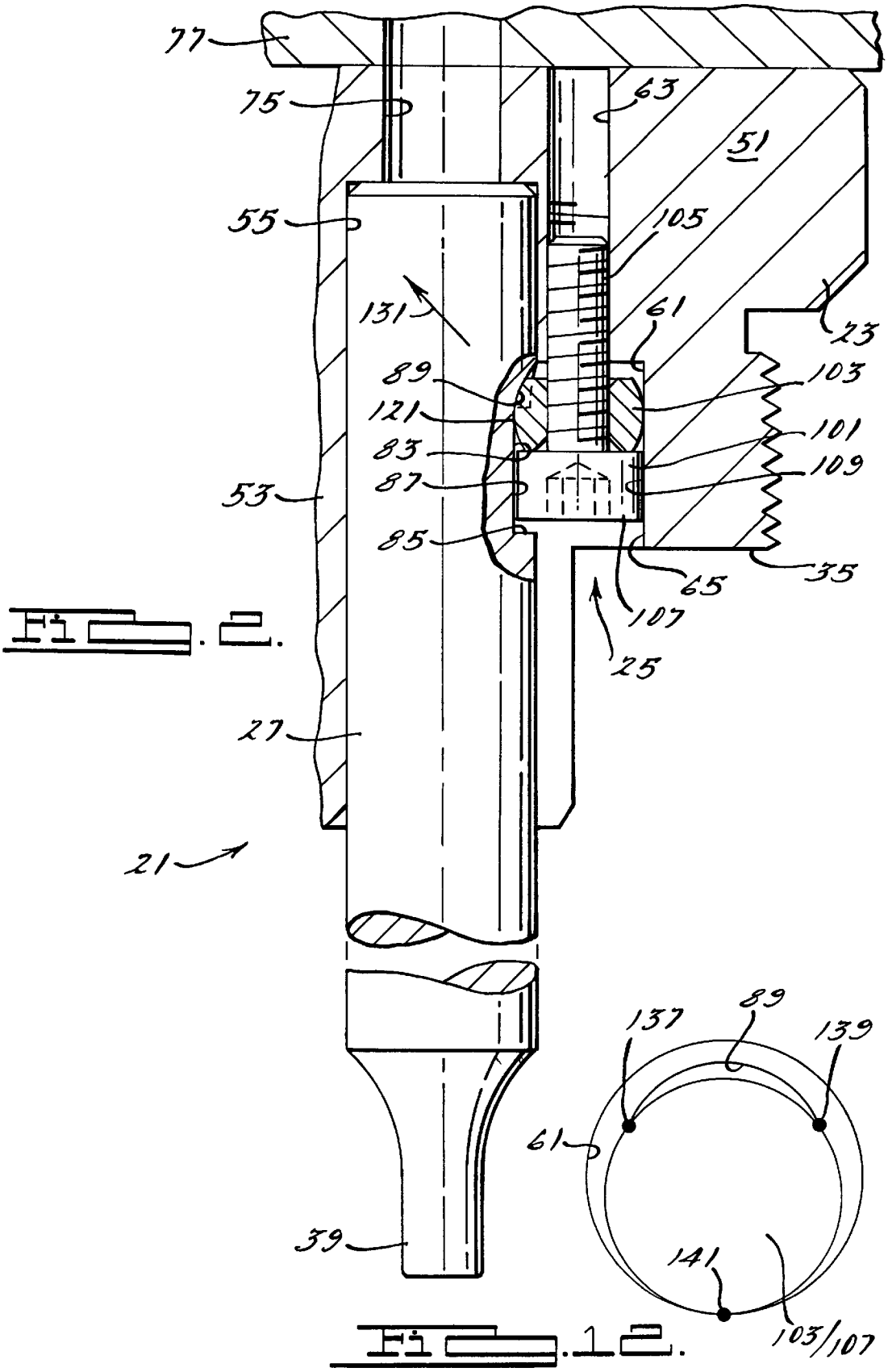
FIG. 2 is a cross sectional view, taken along line 2—2 of FIG. 1, showing the preferred embodiment of the present invention device for retaining the punch.
FIG. 12 is a schematic end view showing the preferred embodiment of the present invention retention device.
Figure 3:
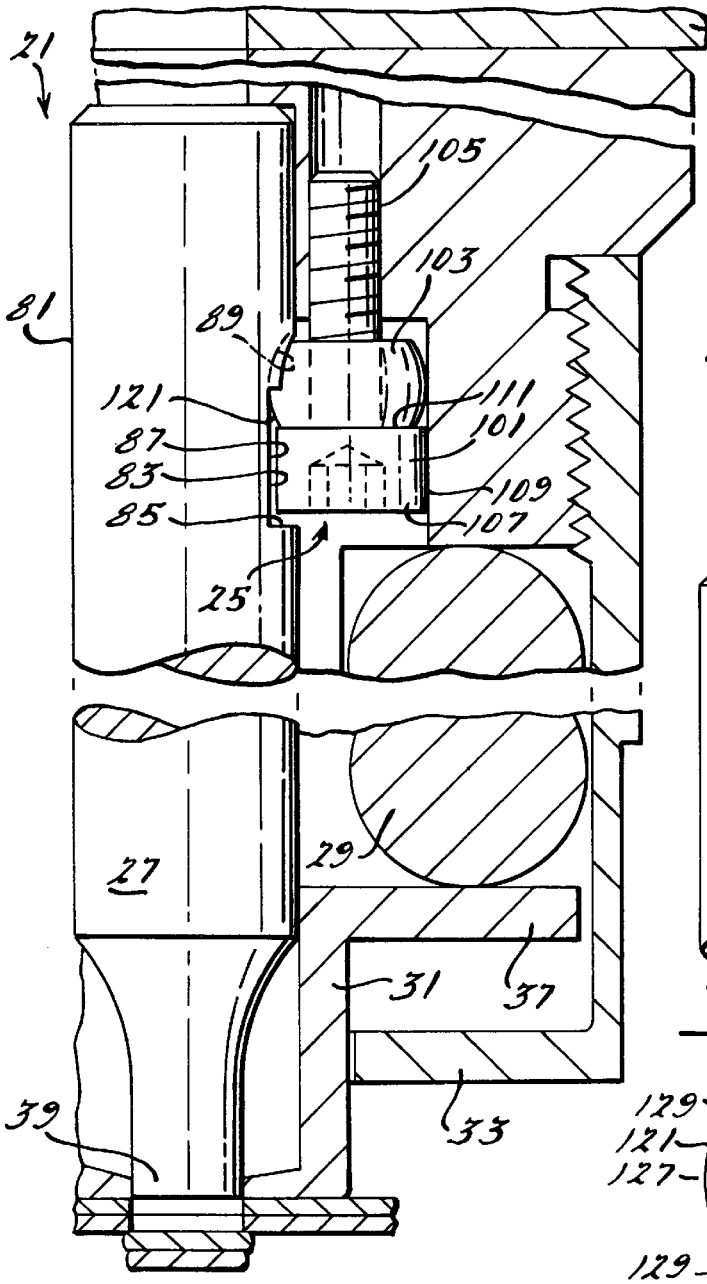
FIG. 3 is a side elevational view showing the preferred embodiment of the present invention device for retaining the punch.
Figure 5:
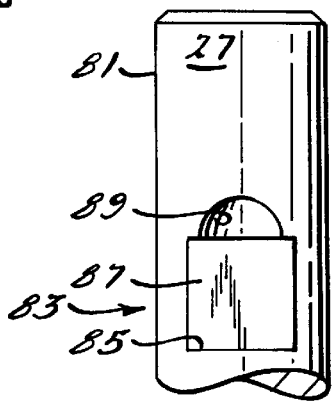
FIG. 5 is a fragmentary side elevational view, as observed perpendicular to that of FIG. 3, showing the preferred embodiment of a recess within the punch of the present invention.
Figure 6:
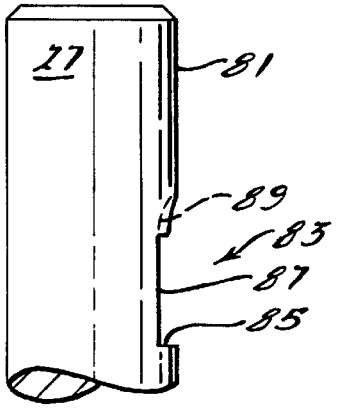
FIG. 6 is a fragmentary side elevational view, as observed from the same direction as FIG. 3, showing the preferred embodiment of the present invention punch.
Figure 7:
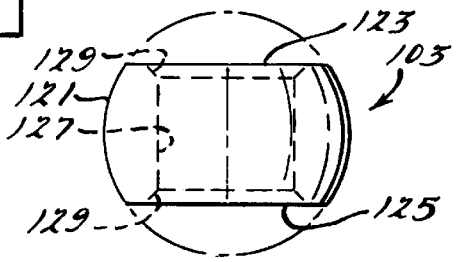
FIG. 7 is a side elevational view showing the preferred embodiment of a washer of the present invention.
Figure 4:
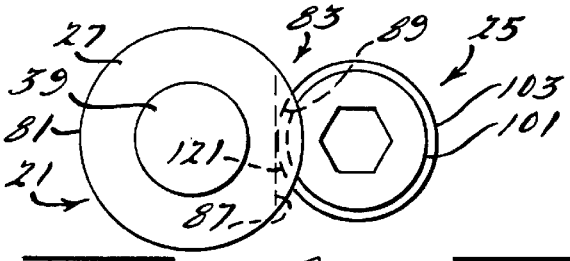
FIG. 4 is a schematic end elevational view of FIG. 3 showing the preferred embodiment of the present invention device for retaining the punch.
Figure 8:
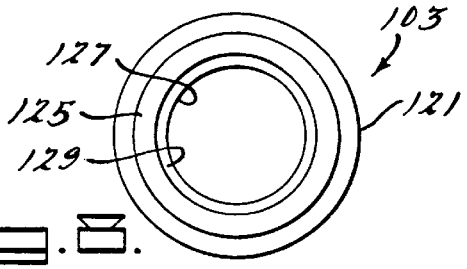
FIG. 8 is an end elevational view showing the preferred embodiment of the present invention washer.
Figure 11:
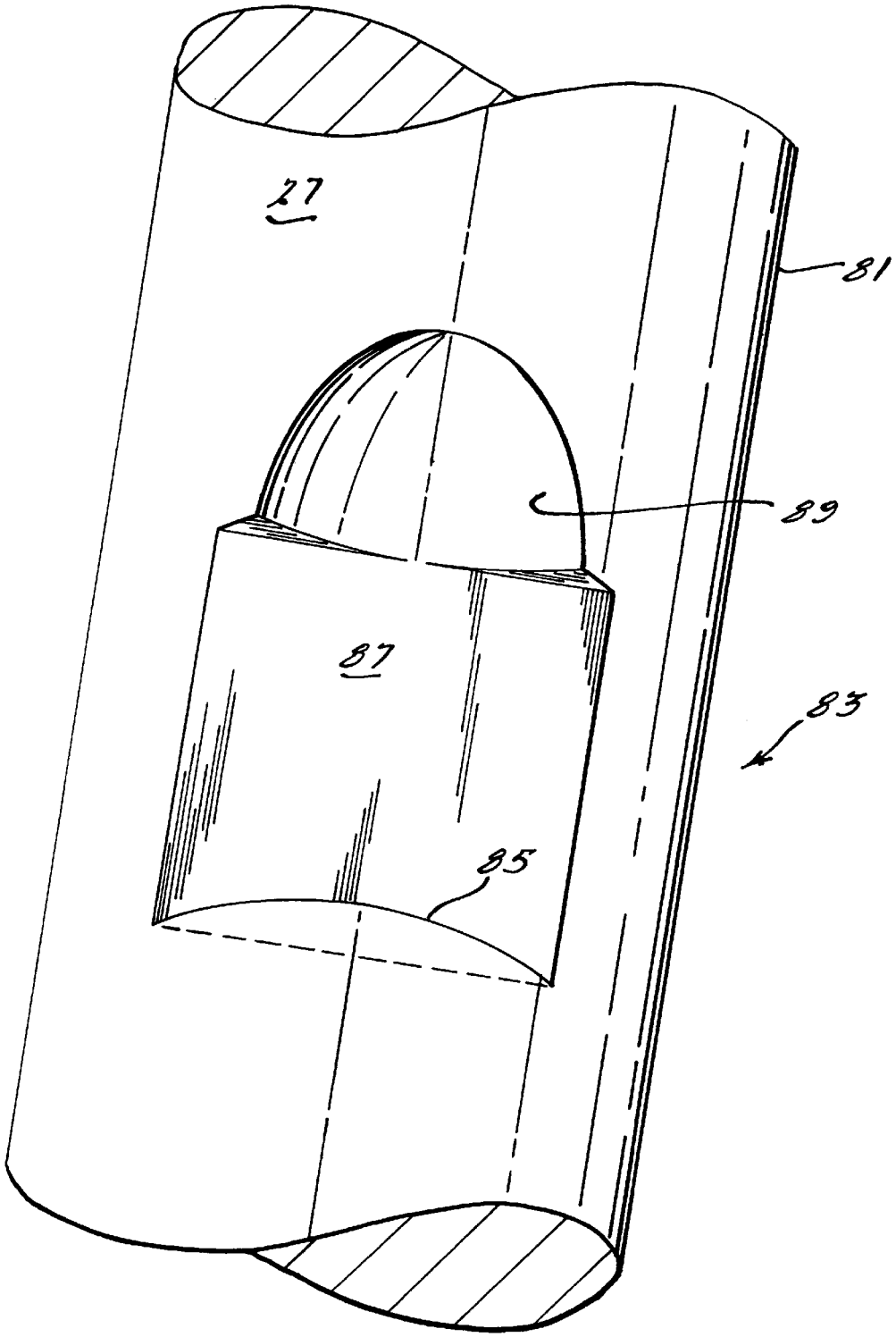
FIG. 11 is a fragmentary perspective view showing the preferred embodiment of the present invention punch.

FIGS. 2 and 12 best illustrate the relationship and interaction of the components of the present invention. Washer 103 is slid onto shank 105, punch 27 is aligned with and inserted into punch receiving cavity 55 of punch holder 23, and then retainer 25 is inserted into counterbore 61 of punch holder 23. Washer 103 and head 107 are received within recess 83 of punch 27 and within enlarged portion 65 of counterbore 61. Subsequently, a wrench is employed to turn screw 101 so as to engage the threads of shank 105 with the threads of counterbore 61. This action causes partially spherical surface 121 of washer 103 to press against the adjacent partially spherical section 89 of recess 83 thereby pushing a base of punch in a first direction 131, laterally away from screw 101 and longitudinally away from distal end 39 of punch 27. This screw tightening or engaging action further causes a slight tilting deflection of head 107 of screw 101 in a second direction opposite from first direction 131. Thus, external surface 109 of head 107 is pushed against the surface of counterbore 61 defining enlarged portion 65.

It is intended that partially spherical surface 121 of washer 103 has a two point contact, designated as 137 and 139, with the adjacent partially spherical section 89 of recess 83. A third point of contact 141 is between the opposite side of head 107 and counterbore 61. It has been found that this provides reliable, repeatable and precise locating and retention of punch 27 within punch holder 23. It is also been found that the use of washer 103 is far superior to just using head 107 of screw 101 in order to reduce part costs by employing standard screw types. Furthermore, this standard screw 101 has a Rockwell C hardness between 38 and 43. However, washer 103 preferably has a Rockwell C hardness between 61 and 65 which is much more suitable for the present use; the hard washer 103 is more resistant to deformation under the high loading conditions and in the vibration prone environment of repeated use.

It is also envisioned that punch 27 may be disengaged from cavity 55 during unscrewing of screw 101. This is effected by abutting head 107 against undercut 85 of recess 83 such that screw 101 acts to push punch 27 in concert with the longitudinal screw movement.

Figure 13:
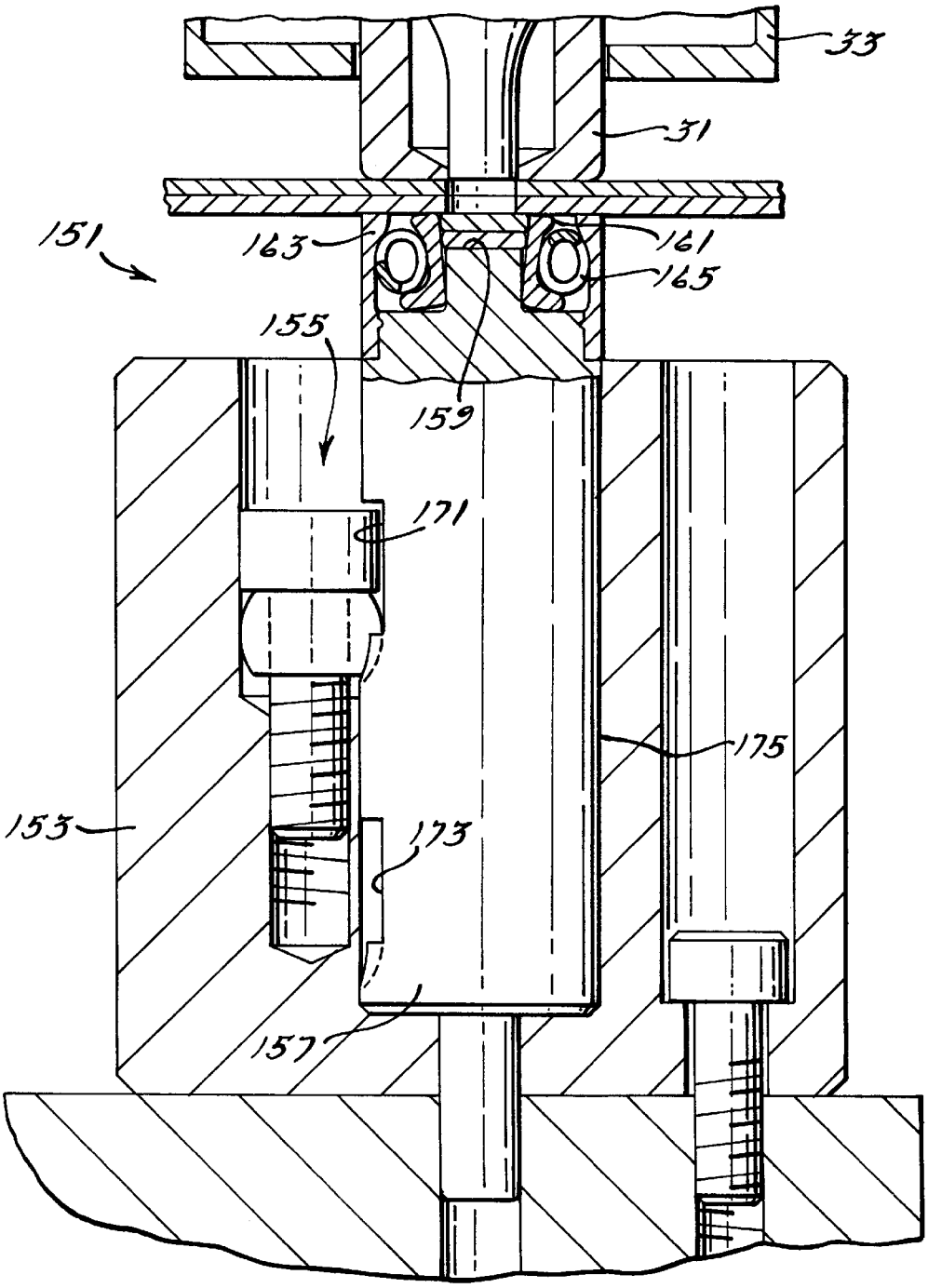
FIG. 13 is a side elevational view, taken partially in section, showing the preferred embodiment of the device retaining a die assembly of the present invention.

Referring now to FIG. 13, a die assembly 151 is shown secured to a die holder 153 by way of a retainer 155 in a manner identical to that previously described for the punch and punch holder. Die assembly 151 employs a die body 157, an anvil 159, three partially cylindrical die blades 161, an outer guard 163 and a canted coil spring 165. Canted coil spring 165 serves to bias die blades 161 against anvil 159. However, elastomeric or other spring configurations could alternately be used. Die blades 161 are outwardly pushed away from anvil 159 when the sheet metal joint is formed. Guard 163 is secured to die body 157 by way of an interference press fit interlocking groove and ridge arrangement. Furthermore, a pair of recesses 171 and 173 are machined within a cylindrical external surface 175 of die body 157. This allows for varied longitudinal placement of retainer 155 when die assembly 151 is employed with differing types of die holders or fixtures.

Various materials and shapes have been disclosed in an exemplary fashion, however, other materials and shapes may of course be employed. It is intended by the following claims to cover these and any other departures from the disclosed embodiments which fall within the true spirit of this invention.

The invention claimed is:

1. A device for securing a tool to a fixture, said device comprising:

a recess disposed in an exterior surface of said tool;

a fastener having a head and a longitudinal shank for connection to said fixture; and an engagement member having a partially spherical external surface and an internal surface defining a longitudinal passageway, said shank of said fastener being received within said passageway of said engagement member, said partially spherical external surface of said engagement member mating with said recess of said tool for securing said tool to said fixture.

2. The device of claim 1 wherein said engagement member has an annular shape with a substantially uniform cross section.

3. The device of claim 2 wherein said engagement member further includes an upper external surface and a lower external surface, said upper and lower external surfaces are substantially flat, said lower external surface directly abuts against said head of said fastener.

4. The device of claim 3 further comprising a frustoconical lead-in surface joining one of said external flat surfaces with said internal surface of said engagement member.

5. The device of claim 2 wherein an outer diameter of said engagement member is greater than a lateral dimension of said head of said fastener.

6. The device of claim 1 wherein said tool is a sheet metal joining punch.

7. The device of claim 6 further comprising:

a stripper spring surrounding a portion of said punch;

a stripper tip biased away from said fixture by said stripper spring, said stripper tip having a centrally located aperture through which a distal end of said punch extends;

a stripper can surrounding said stripper spring and retaining said stripper tip in relation to said punch; and a retaining shoe;

said fixture being defined as a punch holder removably mounted to said retaining shoe, said stripper can being secured to said punch holder.

8. The device of claim 1 wherein said exterior surface of said tool adjacent to said recess has a cylindrical longitudinally oriented shape.

9. The device of claim 8 wherein said recess includes:

an undercut section selectively engaging a substantially flat surface of said head, said undercut section having a substantially lateral orientation;

a substantially flat section being elongated and oriented in a longitudinal direction; and a partially spherical section engaging with said partially spherical external surface of said engagement member.

10. The device of claim 1 further comprising a counterbore disposed within said fixture, a laterally enlarged receptacle of said counterbore receiving and contacting against said head of said fastener, a threaded portion of said counterbore enmeshing with said shank of said fastener.

11. A device for securing a tool to a fixture, said device comprising:

a recess disposed in a cylindrical exterior surface of said tool, said recess having a partially spherical section;

a lateral protuberance having a partially spherical external surface mating with said partially spherical section of said recess; and an elongated member securing said lateral protuberance to said fixture, whereby said tool is secured to said fixture.

12. The device of claim 11 wherein said lateral protuberance is a washer having an annular shape with a substantially uniform cross section.

13. The device of claim 12 wherein said washer further includes an upper external surface and a lower external surface, said upper and lower external surfaces are substantially flat.

14. The device of claim 13 further comprising a frustoconical lead-in surface joining one of said external flat surfaces with said internal surface of said washer.

15. The device of claim 11 wherein said tool is a sheet metal joining punch.

16. The device of claim 15 further comprising:

a stripper spring surrounding a portion of said punch;

a stripper tip biased away from said fixture by said stripper spring, said stripper tip having a centrally located aperture through which a distal end of said punch extends;

a stripper can surrounding said stripper spring and retaining said stripper tip in relation to said punch; and a retaining shoe;

said fixture being defined as a punch holder which is removably mounted to said retaining shoe.

17. The device of claim 11 further comprising:

an enlarged head and a shank disposed on said elongated member; and a counterbore disposed in said fixture, an enlarged receptacle of said counterbore receiving and contacting against said head, a portion of said counterbore receiving said shank.

18. The device of claim 11 wherein said recess further includes an undercut section and a substantially flat middle section, said middle section disposed between said undercut and partially spherical sections.

19. A retention device comprising a tool having an exterior surface with a recess, said recess including an undercut section being oriented in a substantially lateral manner, said recess including a partially spherical section, said recess further including a substantially flat middle section being elongated and oriented in a longitudinal direction, said middle section being disposed between said undercut and partially spherical sections.

20. The device of claim 19 further comprising:

a tool holder having a counterbore and a tool cavity, said base of said tool being received within said tool cavity; and a retainer having a partially spherical protuberance laterally extending from a longitudinally oriented shank, said protuberance engaging with said partially spherical portion of said tool recess, an opening of said counterbore receiving said shank of said fastener, a laterally enlarged receptacle of said counterbore receiving said protuberance.

21. The device of claim 20 further comprising a head of said retainer pushed against an internal surface defining said receptacle of said counterbore during engagement of said protuberance against said recess.

22. The device of claim 19 wherein said exterior surface of said tool, adjacent to said recess, is cylindrical.

23. The device of claim 19 wherein said tool is a sheet metal joining punch further comprising:

a stripper spring surrounding a portion of said punch;

a stripper tip biased away from a base of said punch by said stripper spring, said stripper tip having an aperture through which a distal end of said punch extends; and a stripper can surrounding said stripper spring and retaining said stripper tip in relation to said punch.

24. The device of claim 19 wherein said tool is a die assembly having a body, an anvil and a set of movable die blades.

25. A retention device comprising:

a tool having a cylindrical exterior surface with a recess;

a retainer having a longitudinal shank and a laterally extending protuberance, said protuberance engaging with said recess; and a tool holder having a tool cavity for receiving said tool, a counterbore disposed within said holder, a laterally enlarged receptacle of said counterbore receiving said protuberance of said retainer, an opening of said counterbore receiving said shank of said retainer, a portion of said retainer being pushed against an internal surface defining said receptacle of said counterbore, whereby said retainer secures said tool to said holder.

26. The device of claim 25 wherein said tool is a sheet metal joining punch.

27. The device of claim 26 further comprising:

a stripper spring surrounding a portion of said punch;

a stripper tip being biased away from said fixture by said stripper spring, said stripper tip having a centrally located aperture through which a distal end of said punch extends; and a stripper can surrounding said stripper spring and retaining said stripper tip in relation to said punch.

28. The device of claim 25 wherein said recess includes:

an undercut section being substantially laterally oriented;

a partially spherical section engaging with a partially spherical external surface of said protuberance; and a substantially flat section being elongated and oriented in said longitudinal direction, said flat section being disposed between said undercut and said partially spherical sections.

29. A device for retaining a tool to a fixture, said device comprising:

a fastener having a longitudinal shank and an enlarged head; and an engagement member having a partially spherical external surface and an internal surface defining a longitudinal passageway, said engagement member having an annular shape with a substantially uniform cross section, first and second external surfaces of said engagement member being substantially flat with said second external surface abutting against said head of said fastener.

30. The device of claim 29 further comprising a frustoconical lead-in surface joining one of said external flat surfaces with said internal surface of said engagement member.

31. A method of securing a tool to a fixture by using a retainer having a shank, said method comprising the steps of:

(a) receiving said shank of said retainer in an opening of a counterbore disposed in said fixture;

(b) engaging a lateral protuberance depending from said shank with a recess of said tool;

(c) pushing a portion of said tool against a tool cavity surface within said fixture in a first direction, said first direction being defined as an angle having directional components longitudinally toward a base of said tool and laterally away from said retainer; and (d) pushing a portion of said retainer against a laterally enlarged receptacle wall of said counterbore in a second direction opposite from said first direction.

32. The method claim 31 further comprising the step of engaging a partially spherical external surface of said protuberance with a partially spherical section of said recess.

33. The method of claim 31 further comprising the steps of sliding an engagement member containing said protuberance onto said shank and abutting a flat surface of said engagement member against an enlarged head of said retainer.

* * * * *

UNITED STATES PATENT AND TRADEMARK OFFICE

CERTIFICATE OF CORRECTION

PATENT NO. : 5,860,315
DATED : January 19, 1999
INVENTOR(S) : Edwin G. Sawdon

It is certified that error appears in the above-identified patent and that said Letters Patent is hereby corrected as shown below:

On the title page, Item
[73] Assignee, "ETM" should be -- BTM --.

[60] the following heading and information should be inserted -- Related U.S. Application Data, Continuation-in-part of Ser. No. PCT/US94/08561, Jul. 29, 1994 --.

[56] Foreign Patent Documents, line 3, "372392 A1" should be -- 3726392 A1 --.

Signed and Sealed this

Twenty-ninth Day of June, 1999

*Attest:*

Q. TODD DICKINSON

*Attesting Officer*

*Acting Commissioner of Patents and Trademarks*